US005390433A

United States Patent [19]

Brady

[11] Patent Number: 5,390,433

[45] Date of Patent: Feb. 21, 1995

[54] PRESSING IRON WITH CORD SWIVEL CORD GUARD AND LOBED HEEL

[75] Inventor: Martin Brady, Richmond, Va.

[73] Assignee: Hamilton Beach/Proctor-Silex, Inc., Glen Allen, Va.

[21] Appl. No.: 1,261

[22] Filed: Jan. 7, 1993

[51] Int. Cl.[6] ..... D06F 75/28; D06F 75/30; H01R 35/04

[52] U.S. Cl. ..... 38/79; 38/88; 219/256; D32/70

[58] Field of Search ..... 38/79, 88, 90, 91, 92; 219/245, 247, 250, 254, 256, 259; D26/9, 13, 22; D32/71, 70

[56] References Cited

U.S. PATENT DOCUMENTS

| | | | |
|---|---|---|---|
| D. 163,547 | 6/1951 | Stewart | D26/13 |
| D. 262,771 | 1/1982 | Hanson | D32/70 |
| D. 269,213 | 5/1983 | Martin | D32/70 |
| D. 291,616 | 8/1987 | Hennuy | D32/70 |
| D. 293,146 | 12/1987 | Brun | D32/70 |
| D. 293,147 | 12/1987 | Brun | D32/70 |
| D. 294,991 | 3/1988 | Johnson et al. | D32/70 |
| D. 309,516 | 7/1990 | Klok | D32/70 |
| D. 314,267 | 1/1991 | Johnson et al. | D32/70 |
| 2,249,620 | 7/1941 | Samuels | 219/245 |
| 2,321,509 | 6/1943 | Olving | 38/79 |
| 2,530,540 | 11/1950 | Reichold et al. | 219/256 X |
| 2,536,996 | 1/1951 | Holland et al. | 174/46 |
| 3,428,780 | 2/1969 | DeCrouez | 219/256 |
| 4,357,519 | 11/1982 | Bain, Jr. | 219/256 |
| 4,748,755 | 6/1988 | Bain, Jr. et al. | 219/245 X |

FOREIGN PATENT DOCUMENTS

| | | | |
|---|---|---|---|
| 62333 | 1/1989 | Canada . | |
| 1487647 | 7/1967 | France | 219/256 |
| 2482987 | 11/1981 | France | 219/245 |
| 2752575 | 6/1978 | Germany | 219/256 |

OTHER PUBLICATIONS

Copy of drawings of copending design patent application filed within one year prior to filing date of instant application.

Photocopies of front and back cover pages pp. 214 and 215 of catalog titled, "Best General Merchandise Catalog," 1990/91 published by Best Products Co., Inc.

Set of 5 unpublished photographs of Tefal iron taken for purpose of this Information Disclosure Statement.

Photocopies front and back cover pages and p. 15 showing an iron, item #14400 of "Hamilton Beach/-Proctor Silex" Catalog published by Hamilton Beach/-Proctor Silex, Inc. in Apr. 1992.

Photocopies of front and back cover pages and pp. 4 and 5 of th catalog titled, "Spring 1993 New Products HB/PS Invest in the Best," published by Hamilton Beach/Proctor Silex, Inc. in Dec., 1992.

*Primary Examiner*—Clifford D. Crowder
*Assistant Examiner*—Ismael Izaguirre
*Attorney, Agent, or Firm*—Roger S. Dybvig

[57] ABSTRACT

To accommodate user preferences, an electric pressing iron has a cord guard partly confined within a chamber in the body of the iron that is rotatable into positions in which it extends vertically upwardly, to one side of the iron, or the other side of the iron. Detents formed by confronting surfaces on the iron body frictionally retain the cord guard in the desired position. To enhance the stability of the iron when in an upright orientation, its rear cover has outwardly and rearwardly extending flanges surrounding a recessed center panel. These flanges include side flanges having wavy rearmost edges that further contribute to the stability of the iron.

14 Claims, 1 Drawing Sheet

PRESSING IRON WITH CORD SWIVEL CORD GUARD AND LOBED HEEL

BACKGROUND OF THE INVENTION

This invention relates to an electric pressing iron and particularly to a pressing iron for household use.

One problem addressed by this invention is the need to provide a power cord connection which can meet the preferences of different users. Household irons have cord guards through which the power cords extend, the guards being used to guide the current carrying wire strands to their points of connection to the iron circuitry and to resist severe bending or twisting of the power cords where they enter the irons.

Many pressing irons have power cord attachments which are convenient only to right handed persons who use the irons and are awkward for left handed persons. Some have power cord attachments including cord guards that are assembled by the purchaser before use to one side or the other side of the iron as desired for the convenience of the purchaser. There are other irons having cord guards that are rotatable so that the user can move them from one side of the iron to the other. However, the known irons with rotatable cord guards mount the guards for rotation about generally vertical axes (i.e., axes nearly perpendicular to the bottom surfaces of their sole plates) so that care must be taken to avoid having the cord guards interfere with the placement of the irons on their heel plates or rear covers in vertical or upright resting positions. Cords mounted for rotation about vertical axes also cannot be positioned to extend upwardly from the center of an iron, a position which may be useful for avoiding having a cord drag across the material being ironed. U.S. Pat. No. 2,536,996, granted to Holland et al. on Jan. 2, 1951, discloses devices for attaching a power cord to an iron by which the power cord is mounted for rotation about a generally horizontal axis (i.e., generally parallel to the bottom surface of its sole plate) with detented stop positions on both sides of the iron. This renders the Holland et al. iron convenient for use by both right and left handed persons. However, the Holland et al. cord attachment structure requires relatively complex parts that would be expensive to manufacture and assemble. Further, it is so constructed that the power cord is twisted about its axis when moved from one side of the iron to the other.

A household pressing iron usually incorporates a heel plate or rear cover designed to be temporarily placed in a horizontal position on top of an ironing board while the iron is not in use. This places the iron and its sole plate in a generally vertical or upright orientation so that the heated surface of the sole plate will not rest on the ironing board. Ironing boards typically have a layer of padding underneath a top cover. The surface of the cover is, therefore, flexible and springy and may not support an iron of ordinary construction in a stable position.

SUMMARY OF THE INVENTION

In accordance with this invention, to accommodate user preferences, an electric pressing iron has a cord guard partly confined within a chamber in the body of the iron that is rotatable into positions in which it extends vertically upwardly, to one side of the iron, or the other side of the iron. Detents formed by confronting surfaces on the iron body frictionally retain the cord guard in the desired position.

Further in accordance with this invention, to enhance the positional stability of the iron when it is placed upright on a springy ironing board cover, and perhaps on or partly on a piece of material being ironed, its heel plate or rear cover has outwardly and rearwardly sloping support legs or flanges surrounding a recessed, rearwardly-facing center portion. The recessed portion can receive bulging or other uneven surfaces. The flanges preferably include side flanges having wavy rearmost supporting edges which also accommodate bulging or uneven surfaces.

The construction of a preferred embodiment of this invention, other objects, and the advantages of this invention will become apparent from the following description and the drawings.

DETAILED DESCRIPTION

Figures 1, 2, 3, 4, 5, 6, 7, 8:
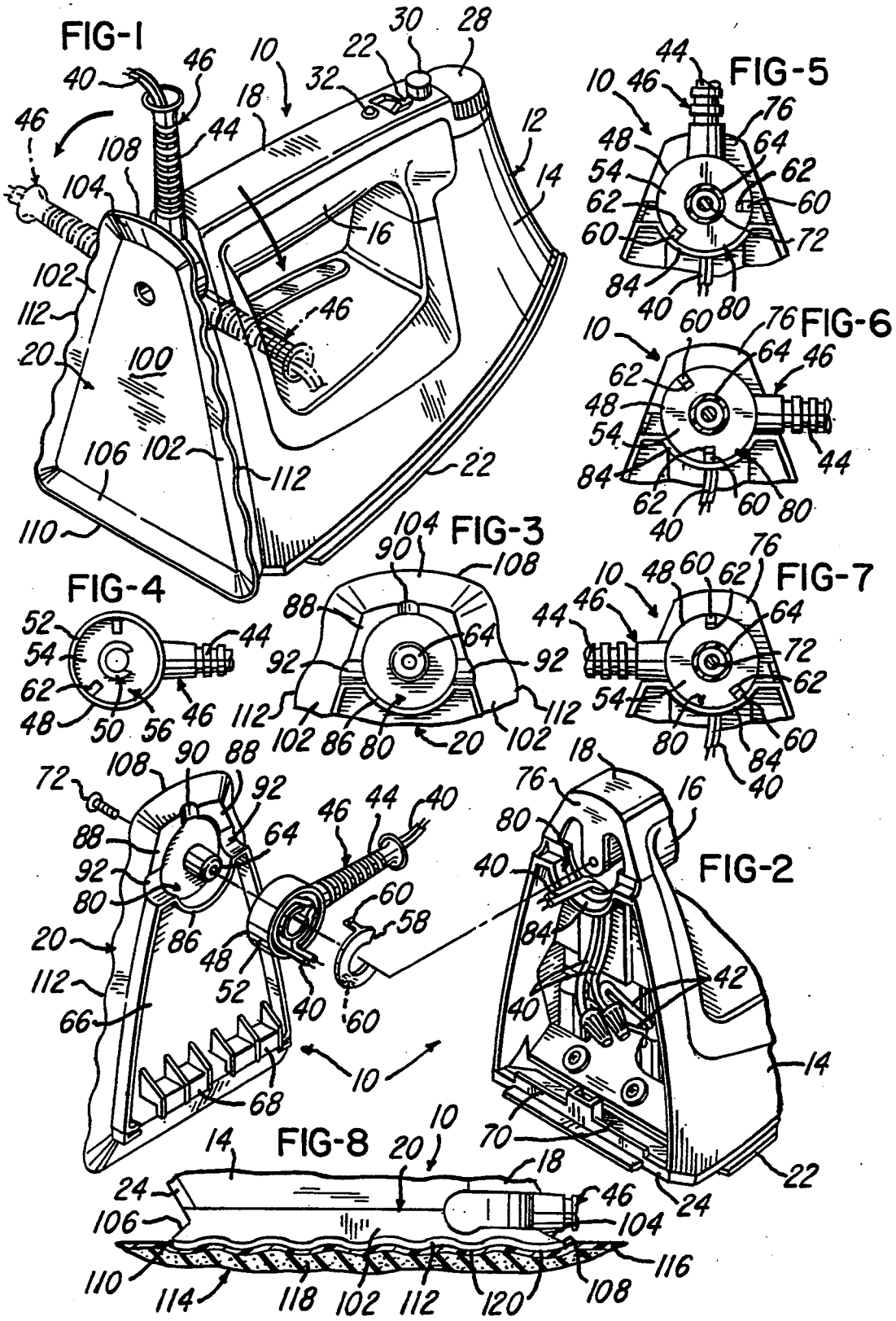
FIG. 1 is a fragmentary, perspective view of a pressing iron made in accordance with this invention.
FIG. 2 is a fragmentary, partly exploded, perspective view of a portion of the pressing iron of FIG. 1.
FIG. 3 is a fragmentary, elevational view of a rear cover forming part of the pressing iron of FIG. 1.
FIG. 4 is a fragmentary, elevational view of a cord guard forming part of the iron of FIG. 1.
FIGS. 5, 6, and 7 are fragmentary, cross-sectional views of a portion of the pressing iron of FIG. 1 that illustrate, respectively, three different positions of a cord guard.
FIG. 8 is a fragmentary, elevational view of the pressing iron of FIG. 1 tilted to its vertical support position and illustrates, in fragmentary cross section, the cover of an ironing board on which the pressing iron is supported.

With reference to FIG. 1, this invention is disclosed for use with a pressing iron, generally designated 10, that comprises a body, generally designated 12, that includes a main body member 14, a handle 16, a top cover 18, and a heel plate or rear cover 20. Each of the body member 14, the handle 16, the top cover 18 and the rear cover 20 is of a one-piece, molded plastic construction. The body 12 is mounted in any suitable fashion on top of a metal sole plate 22 from which it is separated by a plastic base cover 24, as is conventional.

It is well known that, during use of the pressing iron 10, the sole plate 22 is supported and movable in a horizontal plane, usually on top of an ironing board, to iron or press fabric goods. It is also movable to a rest position with the rear cover 20 lying horizontally on the ironing board and with the sole plate 22 projecting upwardly therefrom.

The particular pressing iron 10 illustrated in the drawings is a steam and dry iron and is provided, as is conventional, with a selector switch 26 for selecting steam or dry operation, an on/off temperature control knob 28, a steam/spray pump operating button 30, and a lens 32 for a power-on indicator lamp (not shown), all as will be understood by those familiar with the construction and use of steam irons. With reference also to FIG. 2, an electric power cord 40 has wire strands connected to leads 42 that form part of the control circuitry for heating the sole plate 22 and for generating steam. The control circuitry and the apparatus for heating the sole plate 22 and for controlling the release of steam may be entirely conventional, form no part of this invention, and are not further described herein.

With continued reference to FIGS. 1 and 2, the power cord 40 extends through a hollow tube 44 forming part of a cord guard 46 which may be made from synthetic rubber or the like flexible and resilient material. The cord guard 46 further comprises a hollow cylindrical hub 48 having an inner wall 50 and an outer wall 52 which are bridged by a rear wall 54 and which between them form a circular trough 56 for the wire strands of the power cord 40. The cord strands may be held in the trough 56 by a retaining clip 58 having legs 60 hooked in apertures 62 in the hub rear wall 54.

The hub 48 is mounted for rotation on a hollow stub axle 64 formed integrally with the rear cover 20 and projecting forwardly from its front face 66. To assemble the rear cover 20 onto the rest of the body 12, a pair of connecting hook members 68 on the lower portion of the front face 66 of the rear cover 20 are inserted behind upright flanges 70 formed on the rear of the base cover 24 and the stub axle 64 is inserted through the bore in the center of the cord guard hub 48. A connecting screw 72 is then inserted through the closed front end of the stub axle 64, through an aperture in a plate 76 formed at the rear of the top cover 18, and into threaded engagement with an aperture (not shown) in the rear of the handle 16.

A cord guard-receiving chamber 80, which opens to both sides and to the top of the body 12, is formed between the upper part of the front face 66 of the rear cover 20 and the confronting rear plate 76 of the top cover 18. The chamber 80 is closed at its bottom by a pair of mutually aligned and abutting ledge-forming webs 84 and 86 formed, respectively, on the confronting surfaces of the body member 14 and the rear cover 20.

The cord guard 46 may be rotated about the axis of the stub axle 64 so that it projects upwardly, from the center of the iron 10, as shown in FIG. 5, to one side of the iron 10, as shown in FIG. 6, or to the other side of the iron 10 (FIG. 7). The sides of the ledge formed by the webs 84 and 86 limit the arc through which the cord guard 46 may be rotated so that it cannot rotate downwardly below a plane approximately parallel with the bottom face of the sole plate 22.

With reference to FIGS. 2 and 3, the upper part of the front face 66 of the rear cover 20 that confronts the rear plate 76 of the top cover 18 is formed with forwardly projecting surface portions or pads 88 that are bounded by three recesses or pockets, namely an upper pocket 90 and two side pockets 92. The thickness of the pads 88 is such that the cord guard tube 44 is squeezed between the pads 88 and the rear plate 76 of the top cover 18 whenever the cord guard 46 is between them. The pads 88 thus cooperate with the rear plate 76 of the top cover 18 to form detents that frictionally retain the cord guard tube 44 in one of the three pockets 90 and 92, in the positions respectively illustrated in FIGS. 5, 6 and 7. This renders it convenient to use the iron 10 whether the user is right handed or left handed. It also enables the user to place the cord in the upright position shown in FIG. 5 if desired, as for example, to prevent the power cord 40 from dragging over the material being ironed.

It will be noted that the axis of the stub axle 64, which is perpendicular to the confronting surfaces of the rear cover 22 and the rear plate 76 of the top cover 18, is nearly parallel to the bottom surface of the sole plate 22. Accordingly, the cord guard 46 is rotatable about an approximately horizontal axis when the sole plate 22 is horizontal while being used for pressing. When, as shown in FIG. 8, the iron 10 is tilted to an upright storage or rest position, at which time the rear cover 20 is horizontal, the cord guard 46 is nearly parallel to the horizontal surface on which the rear cover 20 rests. Therefore, regardless of the rotary orientation of the cord guard 46, it will not prevent the iron 10 from remaining in its upright, rest position.

One may change the position of the cord guard 46 relative to the iron body 12 by simply gripping the cord guard 46 and rotating it to a different position. The wire strands of the cord 40 extend around the stub axle 64 and extend from the hub 48 to their points of connection to the internal iron circuitry leads 42 over the ledge-forming web 82 at the rear end of the body member 14. They are free to move over the top of the ledge 82 to follow the hub 48 when it is rotated so that they will not be severely bent or twisted when the cord guard 46 is rotated.

With reference to FIGS. 1, 2, 3 and 8, the rear cover 20 is constructed to enhance the stability of the iron 10 in its rest position. To this end, the rear cover 20 is in the form, as viewed from the rear, of an isosceles trapezoid, and has a flat, rearwardly-facing, center panel 100 bounded by outwardly and rearwardly sloping support legs or flanges. Thus, the rear cover 20 has outwardly sidewardly and rearwardly extending side flanges 102, an upwardly and rearwardly sloping top flange 104 that joins to the top of the side flanges 102, and a downwardly and rearwardly sloping bottom flange 106 that joins to the bottom of the side flanges 102. The top and bottom flanges 104 and 106 terminate in substantially coplanar outermost and rearmost edges 108 and 110, respectively, whereas the side flanges 102 terminate in sinusoidally wavy outermost and rearmost edges 112, the rearmost surfaces of which are substantially coplanar with the top and bottom flange edges 108 and 110. Because of their waviness, both rearmost side edges 112 have plural, mutually equally-spaced, rearwardly-convex lobes 120 with rearwardly concave portions between the lobes 120.

FIG. 8 illustrates an ironing board cover 114 that comprises an outer layer 116 of suitable fabric or other material and an underlying pad 118 of a springy material such as foam rubber. The iron 10 is shown in FIG. 8 in its upright orientation, at which time it is supported by the flanges 102,104 and 106 which, because they are outwardly sloping, will resist any tendency for the iron 10 to tilt and fall over in any direction. When the iron 10 is so supported, the parts of the ironing board cover 114 engaged by the flanges 102, 104 and 106 will be creased or depressed and the surrounding parts of the ironing board cover 14 will tend to bulge upwardly. Because the center panel 100 is recessed from the flange rear edges 108, 110 and 112, a pocket is thereby provided beneath the center panel 100 for receiving upwardly bulging portions of the portion of the ironing board cover 114 surrounded by the flanges 102, 104 and 106. Accordingly, any bulging of the ironing board cover 114 will be unlikely to interfere with the stability of the iron 10. The flanges 102, 104 and 106 will also enhance stability on occasions when the iron 10 is rested on an uneven support surface, such as encountered when the user places the iron on top of, or partly on top of, a garment being ironed.

The lobes 120 function in the manner of supporting fingers and cooperate with the ironing board cover 114 to resist any force that would tend to slide the iron 10 in a horizontal direction and contribute to the resistance to sideways tilting of the iron 10. As shown in FIG. 8, the rearwardly concave surfaces between the lobes 120 receive and accommodate bulging or other uneven support surfaces.

The power cord 40 can easily be wrapped for storage purposes around the top, bottom, and sides of the iron 10 in front of the sloping flanges 102, 104 and 106. It could also be wrapped around the sides and the front and rear ends of the iron 10, in which case the lobes 120 would tend to prevent the turns of the coiled power cord from slipping off the sloping side edges 112 of the rear cover 20.

Not all aspects of this invention need be used together. Rear covers having wavy support edges in accordance with this invention could be used with pressing irons that do not incorporate the rotatable, detented cord guard construction of this invention. So too, the cord attachment construction of this invention can advantageously be used in pressing irons that do not have rear covers with wavy support edges.

Although the presently preferred embodiment of this invention has been described, it will be understood that within the purview of the invention various changes may be made within the scope of the following claims. Among other things, it will be recognized that this invention may be useful with pressing irons other than steam irons.

I claim:

1. In an electric pressing iron comprising a sole plate;

a body having a handle and a rear cover mounted on said sole plate;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement wherein said rear cover has rearwardly facing edges that are sinusoidally wavy upon which said pressing iron is supported in an upright rest position.

2. The electric pressing iron of claim 1 wherein said rearwardly facing edges are side edges that slope upwardly toward one another.

3. The electric pressing iron of claim 1 wherein said rearwardly facing edges project rearwardly from the rest of said rear cover.

4. In an electric pressing iron comprising a sole plate;

a body having a handle and a rear cover mounted on said sole plate;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement wherein said rear cover has outer margins formed by outwardly and rearwardly extending flanges having rearmost edges that provide support for said pressing iron when in its upright rest position, said flanges including outwardly and rearwardly extending side flanges, said rearmost edges of said side flanges having plural, rearwardly convex lobes, and said rear cover has a recessed rearwardly-facing portion surrounded by said flanges.

5. The pressing iron of claim 4 wherein said lobes are aligned in a row of substantially equally spaced lobes extending substantially along the entire length of said rearmost edges.

6. The pressing iron of claim 5 wherein said lobes form part of generally sinusoidal wavy patterns extending along the lengths of said edges of said side flanges.

7. In an electric pressing iron comprising a sole plate;

a body having a handle and a rear cover mounted on said sole plate;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement wherein said rear cover has outer margins formed by outwardly and rearwardly extending flanges having rearmost edges that provide support for said pressing iron when in its upright rest position, said rear cover has a recessed rearwardly-facing portion surrounded by said flanges, and said rear edges include edges that are sinusoidally wavy upon which said pressing iron is supported in an upright rest position.

8. In an electric pressing iron comprising a sole plate;

a body having a handle and a rear cover mounted on said sole plate.;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement wherein said rear cover has outer margins formed by outwardly and rearwardly extending flanges having rearmost edges that provide support for said pressing iron when in its upright rest position, said rear cover has a recessed rearwardly-facing portion surrounded by said flanges, said recessed portion comprises a center panel, and said flanges include outwardly and rearwardly extending side flanges, said rearmost edges of said side flanges having plural, rearwardly convex lobes.

9. The pressing iron of claim 8 wherein said lobes are aligned in a row of substantially equally spaced lobes extending substantially along the entire length of said rearmost edges.

10. The pressing iron of claim 9 wherein said lobes form part of generally sinusoidal wavy patterns extending along the lengths of said edges of said side flanges.

11. In an electric pressing iron comprising a sole plate;

a body having a handle and a rear cover mounted on said sole plate;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement comprising:

said rear cover having outer margins formed by outwardly and rearwardly extending flanges including outwardly and rearwardly extending side flanges, said side flanges having non-linear rearmost edges that provide support for said pressing iron when in its upright rest position, and said edges having plural, rearwardly convex lobes;

a chamber in said body opening to the top and both sides of said iron, said chamber formed in part by a pair of mutually confronting walls formed on said handle and said rear cover;

a cord guard partly confined within said chamber, said cord guard including a hollow tube through which the power cord extends;

means mounting said cord guard for rotation about an axis which is generally perpendicular to said mutually confronting walls and which extends through said rear cover, said cord guard being movable through an arc about said axis from a first position in which said hollow tube projects to one side of said body into a second position in which said hollow tube projects to the other side of said body;

and detent means formed by said confronting walls of said chamber, said detent means engaging said cord guard and frictionally retaining said cord guard in one of said positions.

12. The pressing iron of claim 1 wherein said lobes are aligned in a row of substantially equally spaced lobes, substantially along the entire length of said rearmost edges.

13. The pressing iron of claim 12 wherein said lobes form part of generally sinusoidal wavy patterns extending along the length of said edges.

14. In an electric pressing iron comprising a sole plate;

a body having a handle and a rear cover mounted on said sole plate;

and an electric power cord for supplying power to heat said sole plate;

said iron being used with said sole plate supported and movable in a horizontal plane for ironing and said iron being movable to a rest position with said rear cover supported in a horizontal plane and said sole plate projecting upwardly therefrom, the improvement comprising:

said rear cover having rearwardly facing edges that are sinusoidally wavy upon which said pressing iron is supported in an upright rest position;

a chamber in said body opening to the top and both sides of said iron, said chamber formed in part by a pair of mutually confronting walls formed on said handle and said rear cover;

a cord guard partly confined within said chamber, said cord guard including a hollow tube through which the power cord extends;

means mounting said cord guard for rotation about an axis which is generally perpendicular to said mutually confronting walls and which extends through said rear cover, said cord guard being movable through an arc about said axis from a first position in which said hollow tube projects to one side of said body into a second position in which said hollow tube projects to the other side of said body;

and detent means formed by said confronting walls of said chamber, said detent means engaging said cord guard and frictionally retaining said cord guard in one of said positions.

* * * * *